US009061817B2

(12) United States Patent
Lind et al.

(10) Patent No.: US 9,061,817 B2
(45) Date of Patent: Jun. 23, 2015

(54) SPRAY DEVICES AND METHODS FOR USING THE SAME

(75) Inventors: James Lind, Lenexa, KS (US); Steven Sweeton, Lake Winnebago, MO (US)

(73) Assignee: MeadWestvaco Calmar, Inc., Richmond, VA (US)

( * ) Notice: Subject to any disclaimer, the term of this patent is extended or adjusted under 35 U.S.C. 154(b) by 118 days.

(21) Appl. No.: 13/128,984

(22) PCT Filed: Nov. 11, 2009

(86) PCT No.: PCT/US2009/063995
§ 371 (c)(1),
(2), (4) Date: May 27, 2011

(87) PCT Pub. No.: WO2010/056724
PCT Pub. Date: May 20, 2010

(65) Prior Publication Data

US 2011/0220685 A1 Sep. 15, 2011

Related U.S. Application Data

(60) Provisional application No. 61/114,043, filed on Nov. 12, 2008.

(51) Int. Cl.
*B65D 83/00* (2006.01)
*B65D 83/20* (2006.01)
*B65D 83/22* (2006.01)

(52) U.S. Cl.
CPC ..... *B65D 83/206* (2013.01); *B65D 83/22* (2013.01)

(58) Field of Classification Search
CPC ..... B65D 83/206; B65D 83/22
USPC ..... 222/153.11, 153.13, 162, 182, 183, 222/321.8, 325, 402.1, 402.11, 402.13, 222/402.21
See application file for complete search history.

(56) References Cited

U.S. PATENT DOCUMENTS

| | | | | |
|---|---|---|---|---|
| 3,409,186 | A | 11/1968 | Melocchi | |
| 3,549,055 | A * | 12/1970 | Gatland | 222/182 |
| 3,726,444 | A * | 4/1973 | Ostrowsky et al. | 222/402.11 |
| 3,888,392 | A * | 6/1975 | Van Coney | 222/108 |
| 3,946,911 | A * | 3/1976 | Morane et al. | 222/402.11 |
| 4,582,228 | A * | 4/1986 | Diamond et al. | 222/153.11 |
| 5,138,180 | A * | 8/1992 | Yamanaka | 250/559.07 |
| 5,139,180 | A * | 8/1992 | Lucas | 222/402.13 |
| 6,792,941 | B2 * | 9/2004 | Andersson | 128/200.23 |
| 6,978,945 | B2 * | 12/2005 | Wong et al. | 239/288.5 |
| 2002/0008119 | A1 * | 1/2002 | Clark et al. | 222/153.11 |
| 2005/0184093 | A1 | 8/2005 | Brunerie | |
| 2008/0061087 | A1 * | 3/2008 | Reedy et al. | 222/402.15 |

FOREIGN PATENT DOCUMENTS

JP 09086574 3/1997

OTHER PUBLICATIONS

International Search Report for PCT/US2009/063995 dated Mar. 5, 2010.

* cited by examiner

*Primary Examiner* — Daniel R Shearer
(74) *Attorney, Agent, or Firm* — MeadWestvaco Intellectual Property Group

(57) ABSTRACT

Aerosol spray devices (100) may include one or more actuators (130) located on the sides or on the rear of the device wherein actuation of the one or more actuators disperses product from a container in communication with the spray device. A selector mechanism (150) may be used to toggle between an "on" and an "off" position for the one or more actuators.

11 Claims, 13 Drawing Sheets

SPRAY DEVICES AND METHODS FOR USING THE SAME

CROSS-REFERENCE TO RELATED APPLICATIONS

This application is a national phase application of PCT/US09/63995, entitled "SPRAY DEVICES AND METHODS FOR USING THE SAME" filed on 11 Nov. 2009, and claims the benefit of U.S. Provisional Application No. 61/114,043, entitled "SPRAY DEVICES AND METHODS FOR USING THE SAME," filed 12 Nov. 2008, and incorporates each of the same herein by reference in their entireties.

BACKGROUND OF THE INVENTION

1. Field of the Invention

Embodiments of the invention relate to spray devices and more particularly to aerosol spray devices having actuation mechanisms on one or more sides of the device, at the rear of the device, or on the sides and rear of the device.

2. State of the Art

Spray devices are well known and are used to deliver a variety of products. For example, finger pumps and trigger sprayers may be used to deliver a fluid from a container onto a surface or into a volume of space. Similarly, aerosol sprayers are used to spray an aerosolized product onto a surface or into a volume of space. Many different types of spray devices are known.

Aerosol spray devices typically include a pushbutton type spray device containing an orifice and a connection to a valve which is in turn connected to a container of product from which the aerosol product is dispensed. Actuation of the pushbutton releases a quantity of product from the aerosol container through the valve and the pushbutton. More recently, aerosol spray devices have been modified to look more like trigger sprayers and such devices may include a trigger attached to, or in communication with, a manifold which is connected to the valve of an aerosol container. Actuation of the trigger may release product from the aerosol container through the valve, into the manifold, and out an orifice of the trigger spray device.

While the aerosol pushbutton actuators and trigger actuators are usable, new, alternative methods for delivering or actuating a spray from aerosol containers or other containers are desirable. In addition, one handed operation of such devices is desirable.

BRIEF SUMMARY OF THE INVENTION

According to embodiments of the invention, a spray device may include side-actuated buttons, levers, or other devices to actuate the spray device so that a product may be delivered from a container through the spray device.

According to certain embodiments of the invention, one or more side actuated buttons or actuators may be incorporated with the shroud of a spray device or may be attached or in communication with the shroud of the spray device. Upon actuation of the one or more side actuated buttons, the spray device is actuated to deliver a product from a container to which the spray device may be connected.

According to other embodiments of the invention, a button or actuator of a spray device may be located at the rear of the spray device or at a side opposite of the orifice or orifice cup of the spray device. When actuated, the button or actuator may activate the spray device to deliver a product from a container attached to the spray device.

In still other embodiments of the invention, a selector mechanism may be used to toggle between an "on" and an "off" position for the one or more actuators or for the rear actuator. The selection mechanism may be manipulated by a user to control when the spray device is capable of dispersing a product from a container in communication with the spray device.

Additional embodiments of the invention may include selectors or features for selecting a discharge orifice or dispersion pattern for the spray device.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

According to embodiments of the invention, a spray device may include one or more actuators for actuating a discharge from the spray device. The one or more actuators may be located on the sides of, or on the rear of, the spray device. Actuation of the one or more actuators may result in the dispersion of a product from a container connected to the spray device.

Figures 1, 2:
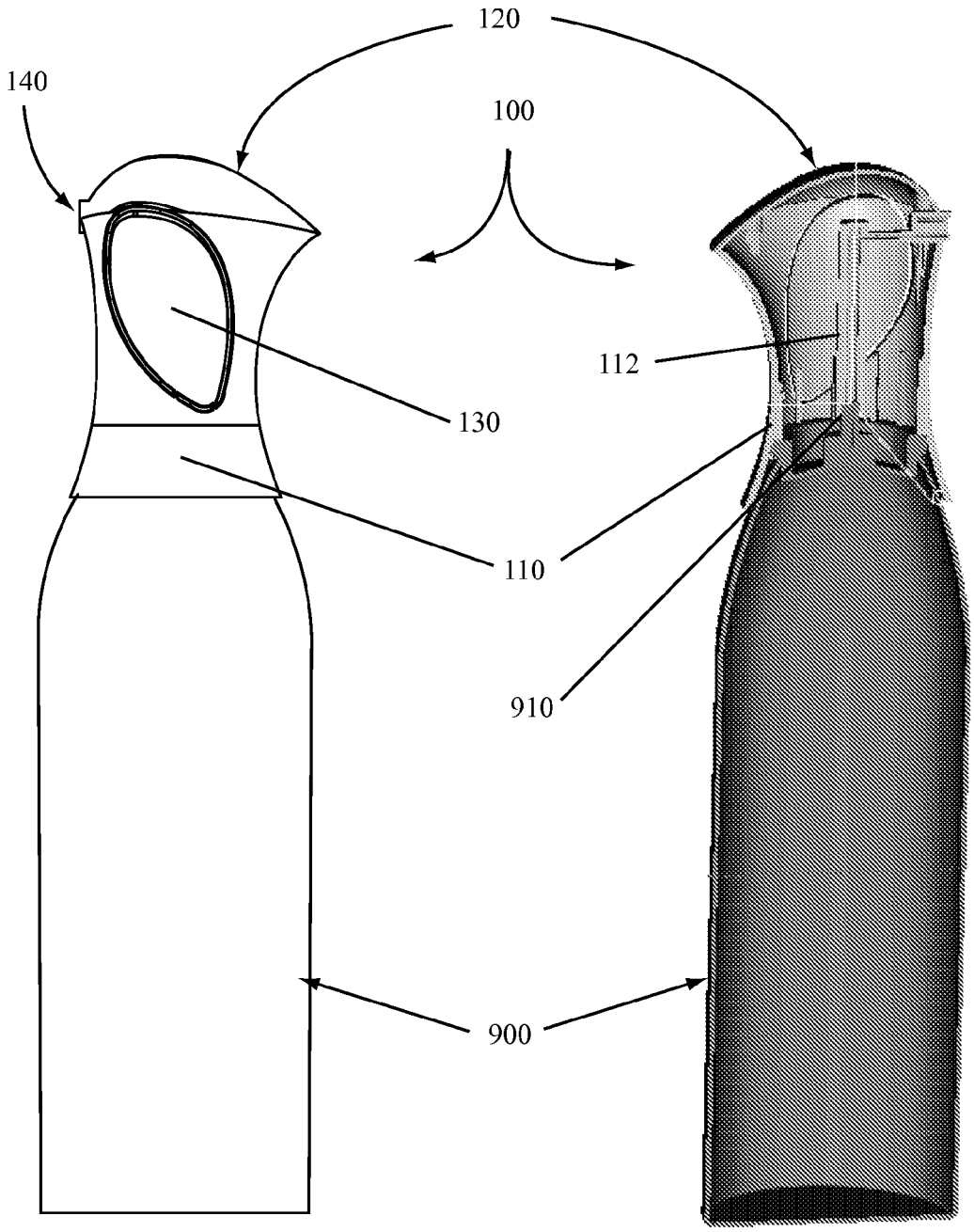
FIG. 1 illustrates a spray device according to embodiments of the invention.
FIG. 2 illustrates a cross-sectional illustration of the spray device illustrated in FIG. 1.

A spray device 100 according to certain embodiments of the invention is illustrated in FIG. 1. As illustrated, the spray device 100 may be connected to a container 900 from which a product may be dispersed. For example, the spray device 100 may be connected to an aerosol container having a conventional aerosol valve system. Connection of the spray device 100 to the container 900 may be accomplished using any known method. The spray device 100 may include a shroud 110, a cap 120, one or more actuators 130, and an orifice cup 140. The one or more actuators 130 may be located on the side of the shroud 110 or at the rear of the shroud 110. The one or more actuators 130 may be integrally formed with the shroud 110 or may be connected to the shroud 110 or fit within recesses of the shroud 110.

As illustrated in FIG. 2, the spray device 100 may include a manifold 112 connected to a valve element 910, such as a valve stem, which is connected to the container 900. The manifold 112 may be connected to or in communication with the one or more actuators 130 such that actuation of the one or more actuators 130 may move the manifold 112, causing product to be released through the valve element 910 from the container 900.

Figure 3:
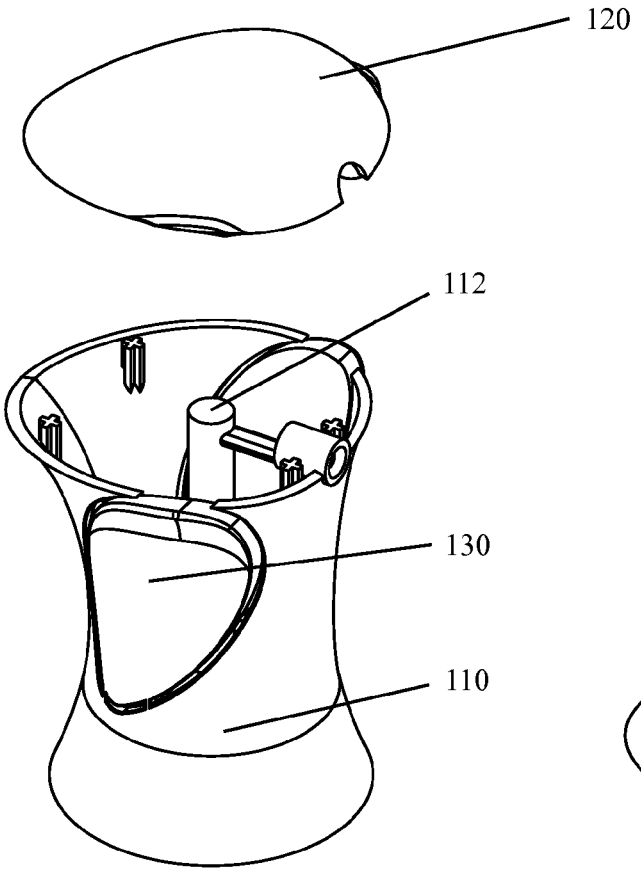
FIG. 3 illustrates a spray device according to embodiments of the present invention.
Figure 4:
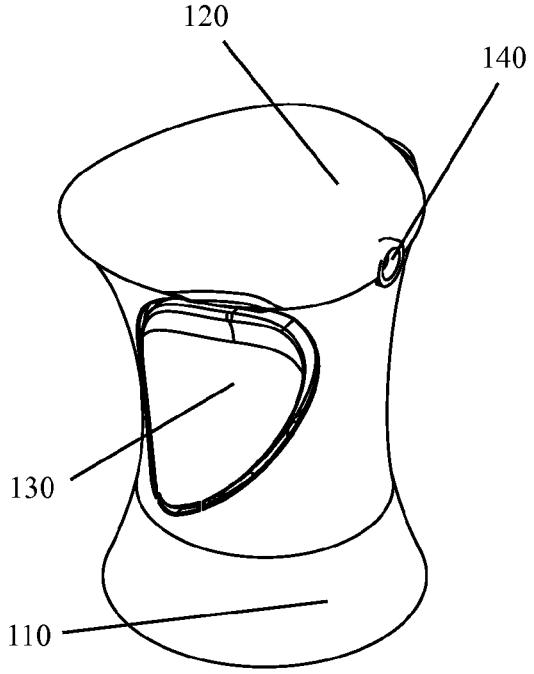
FIG. 4 illustrates a spray device according to embodiments of the present invention.

For example, according to some embodiments of the invention, the shroud 110, one or more actuators 130, and the manifold 112 may be molded as an integral part wherein the manifold 112 is connected to at least one of the one or more actuators 130. FIG. 3 illustrates the components of a spray device 100 according to embodiments of the invention wherein the shroud 110, one or more actuators 130, and manifold 112 constitute a single molded piece. A cap 120, made of a second molded piece, may be snap-fit or otherwise attached to the shroud 110 to form the spray device 100 as illustrated in FIG. 4. An orifice cup 140 may be molded as part of the manifold 112 or may be inserted into the manifold 112 at the orifice opening of the spray device 100. The spray device 100 may be connected to a container 900 as desired such that the spray device 100 may be used to deliver product from the container 900 through the orifice opening upon actuation of one or more of the actuators 130.

Figure 5:
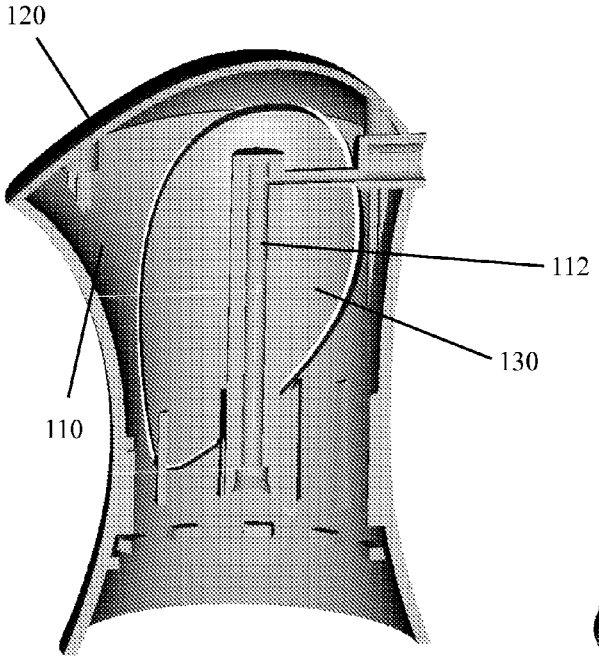
FIG. 5 illustrates a cross-sectional view of a spray device according to embodiments of the invention.
Figure 6:
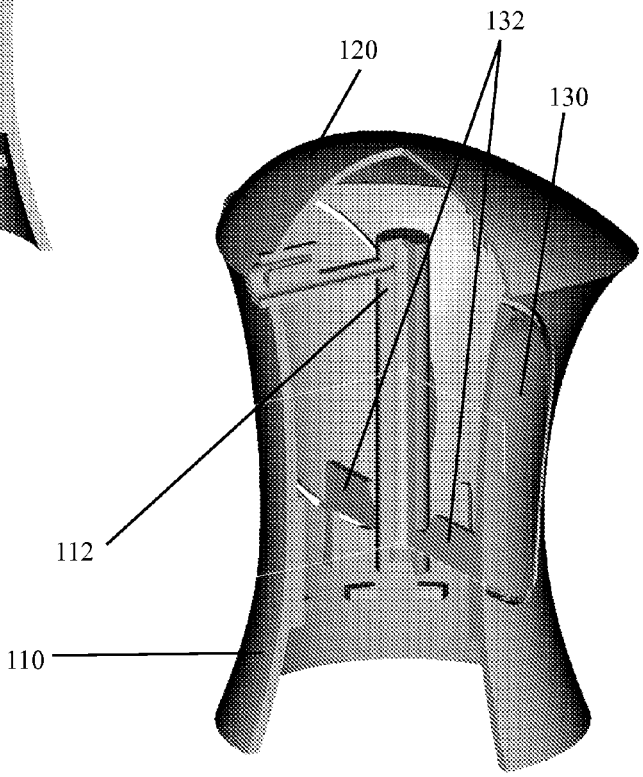
FIG. 6 illustrates a cut-away view of a spray device according to embodiments of the invention.

FIG. 5 illustrates a cross-sectional view of a spray device 100 according to embodiments of the invention. As illustrated, the spray device 100 may include a shroud 110, one or more actuators 130, a manifold 112, and a cap 120 attached to or mated with the shroud 110. FIG. 6 illustrates an alternate cross-sectional view of the spray device 100 illustrated in FIG. 5 wherein the actuator connectors 132 connecting the one or more actuators 130 with the manifold 112 are visible.

Figure 7:
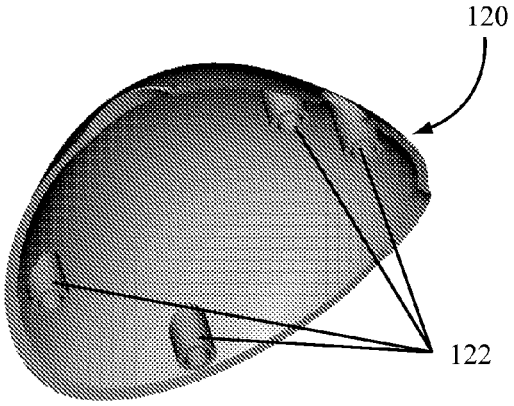
FIG. 7 illustrates a spray device cap according to embodiments of the invention.
Figure 8:
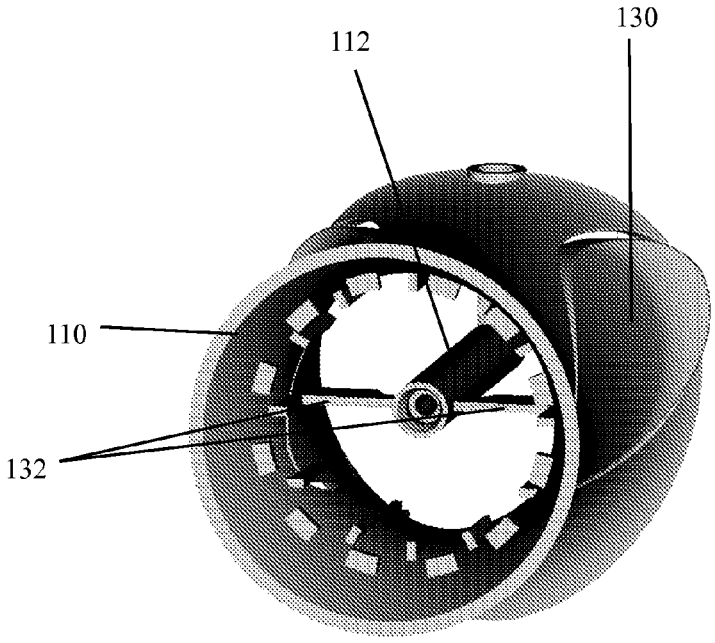
FIG. 8 illustrates a spray device shroud and manifold combination according to embodiments of the invention.

FIGS. 7 and 8 illustrate alternate views of a spray device 100 according to embodiments of the invention. FIG. 7 shows a bottom view of the cap 120 of a spray device 100 according to embodiments of the invention. As illustrated, the cap 120 may include one or more connectors 122 which may mate with or connect to one or more shroud connectors (not shown) on the shroud 100 to form the spray device 100. As illustrated in FIG. 8, the actuator connectors 132 may connect the one or more actuators 130 with the manifold 112 or allow the one or more actuators 130 to contact a manifold 112 when actuated. As a result, pressure or forces applied to any of the one or more actuators 130 may be transferred to the manifold 112, causing it to flex or move such that the manifold 112 actuates a valve, releasing product from a container 900 through the manifold.

According to embodiments of the invention, a spray device 100 may be used to deliver or to spray the contents of a container 900. For example, the spray device 100 illustrated in FIGS. 1 through 8 may be attached to a container 900, such as an aerosol container fitted with a valve system. A user may grip the spray device 100 and actuate at least one of the one or more actuators 130. Actuation of at least one of the one or more actuators 130 may result in the dispersion of a product from the container 900 out of the spray device 100.

According to embodiments of the invention, when at least one of the one or more actuators 130 are pressed or are otherwise actuated, the one or more actuators 130 act on a manifold 112 of the spray device 100, causing the manifold 112 to move in relation to a valve element 910 attached to the container 900. Movement of the valve element 910 opens a valve, allowing product to escape the container 900, flow through the manifold 112 and exit the spray device 100. In some embodiments of the invention, an orifice cup 140 may be inserted into an end of the manifold 112 to alter or improve the spray mechanics of the spray device 100. For instance, an orifice cup 140 may be used to improve the dispersion or droplet creation of the product exiting the spray device 100.

According to various embodiments of the invention, a spray device 100 may be made of a resin based material, a plastic material, metal, or other material. In some embodiments, the components of a spray device 100 may be molded from a resin or plastic material, or other material, and assembled as desired.

Figure 9:
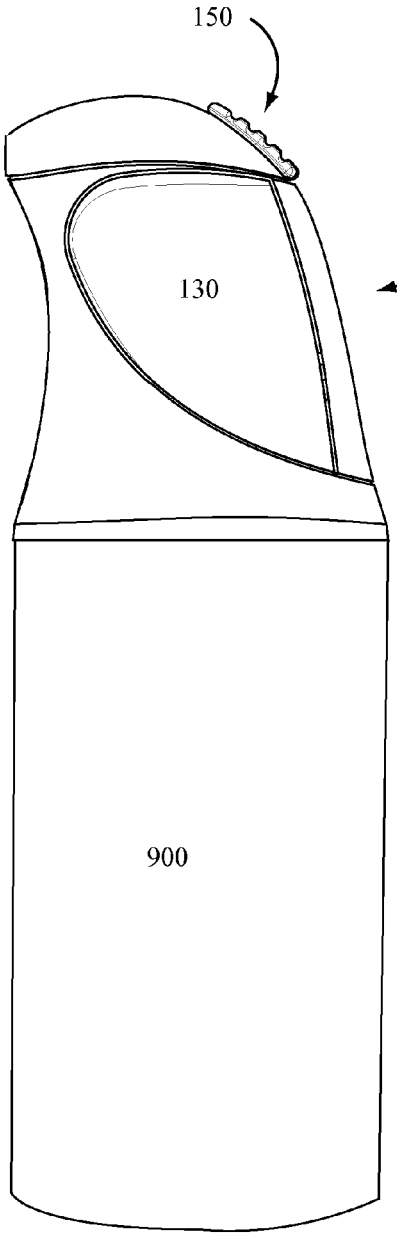
FIG. 9 illustrates a spray device and container according to embodiments of the invention.
Figure 10:
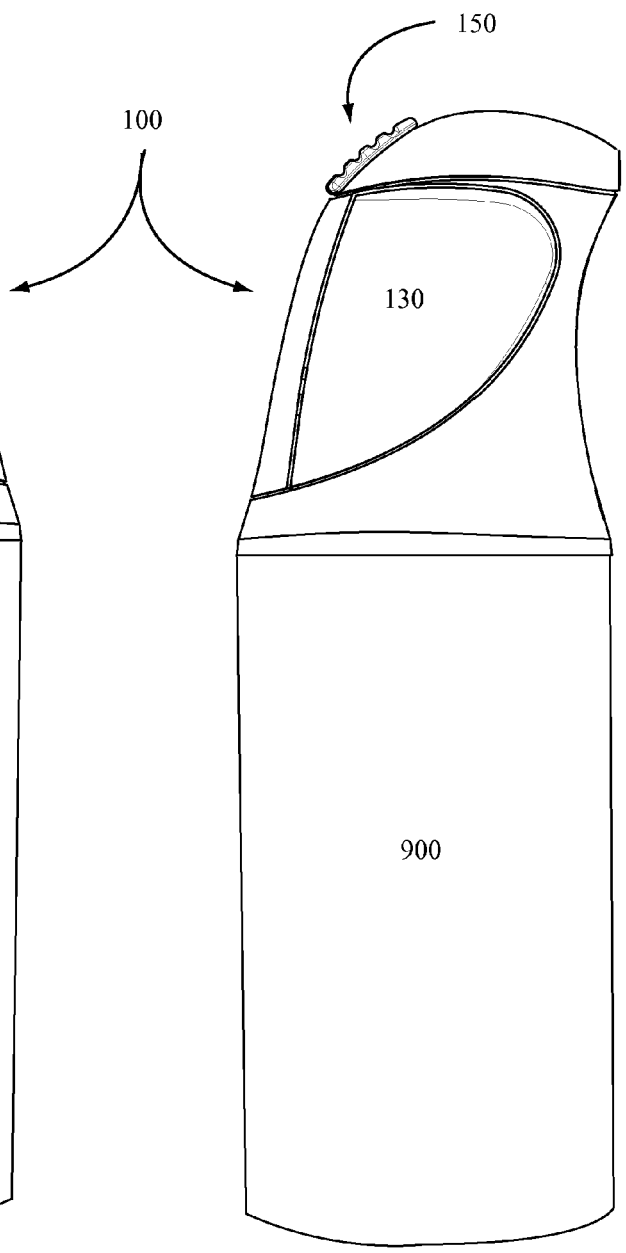
FIG. 10 illustrates a spray device and container according to embodiments of the invention.

FIGS. 9 through 16 illustrate a spray device 100 according to alternative embodiments of the invention. FIGS. 9 and 10 illustrate side views of a spray device 100 attached to a container 900. The spray device 100 may include one or more actuators 130 and a selector mechanism 150. The one or more actuators 130 may be pressed or may have a force applied to at least one of the one or more actuators 130 to actuate the spray device 100 and to disperse a product from the container 900.

Figure 11:
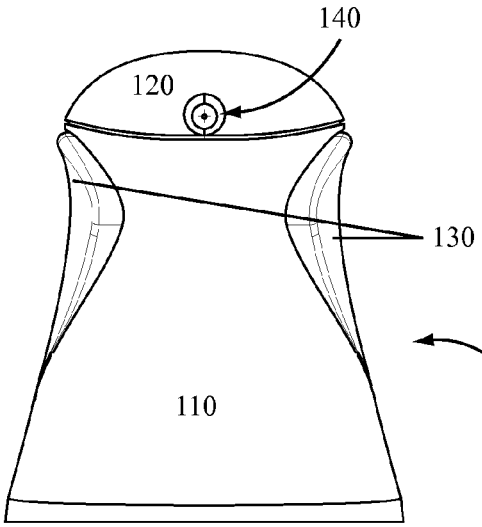
FIG. 11 illustrates a front view of a spray device according to embodiments of the invention.
Figure 12:
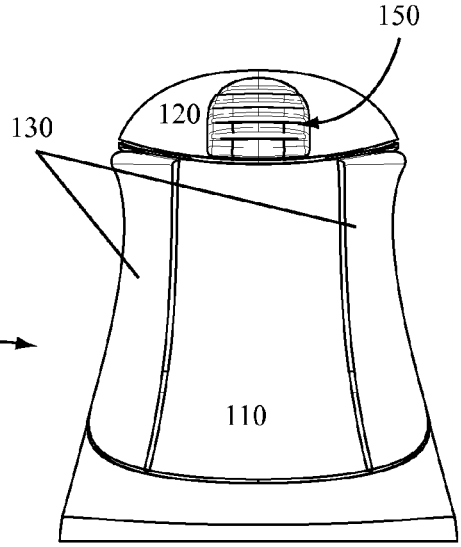
FIG. 12 illustrates a rear view of a spray device according to embodiments of the invention.

A front view of a spray device 100 according to embodiments of the invention is illustrated in FIG. 11. The spray device 100 may include a shroud 110, one or more actuators 130, a cap 120, and an orifice cup 140. According to some embodiments of the invention, the orifice cup may be molded with, or a part of, the cap 120 or the shroud 110. As illustrated in FIG. 12, a rear view of the spray device 100 illustrated in FIG. 11, the spray device 100 may also include one or more selector mechanisms 150. The selector mechanism 150 may be used to select an "on" or "off" position for the spray device 100. According to some embodiments of the invention, the selector mechanism 150 may be positioned or moved to engage the one or more actuators 130, thereby preventing movement of the one or more actuators 130 and preventing the spray device 100 from dispensing a product. The selector mechanism 150 may also be positioned or moved such that the one or more actuators 130 are not engaged, allowing the one or more actuators 130 to be activated to disperse or spray a product from the container 900.

Figure 13:
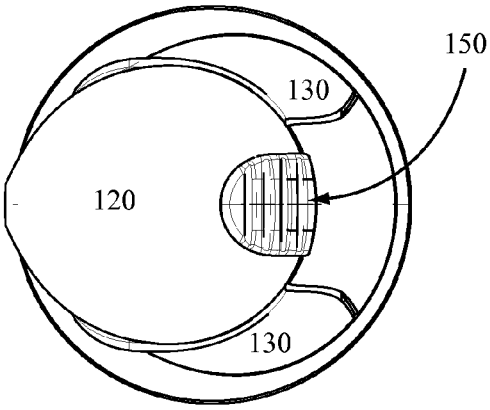
FIG. 13 illustrates a top view of a spray device according to embodiments of the invention.

A top view of a spray device 100 according to embodiments of the invention is illustrated in FIG. 13. The selector mechanism 150 may be moved by a user to allow or disallow activation of the one or more actuators 130.

Figure 14:
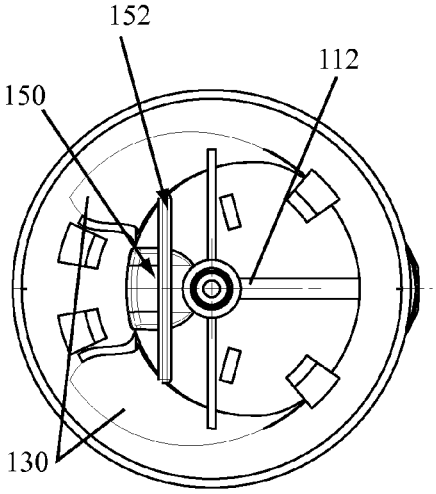
FIG. 14 illustrates a bottom view of a spray device according to embodiments of the invention.

As illustrated in FIG. 14, the selector mechanism 150 may include a bar 152 or other engagement device that may engage with an interior surface of the one or more actuators 130 when the selector mechanism 150 is in an "off" position. When the selector mechanism 150 is moved to an "on" position, the bar 152 or other engagement device may be moved such that it will not engage with the one or more actuators 130, allowing the one or more actuators 130 to be actuated.

While the selector mechanism 150 illustrated in FIGS. 9 through 16 may be used with various embodiments of the invention, it is understood that other mechanisms may be used as selector mechanisms 150 according to various embodiments of the invention or to allow or prevent one or more actuators 130 from actuating.

Figure 15:
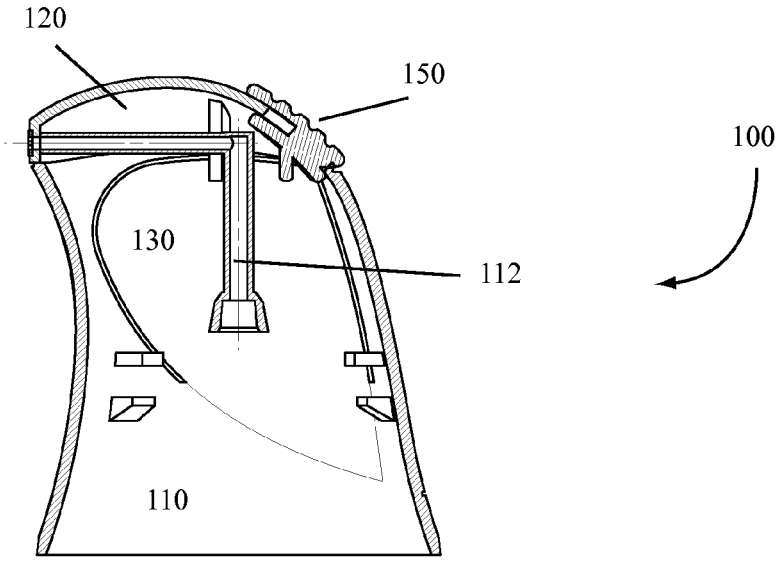
FIG. 15 illustrates a cross-sectional side view of a spray device according to embodiments of the invention.

FIG. 15 illustrates a cross-sectional side view of the spray device 100 illustrated in FIGS. 9 through 14. The spray device 100 may include a shroud 110, manifold 112, one or more actuators 130, cap 120, and selector mechanism 150. As illustrated, the selector mechanism 150 may be fitted in the cap 120 or between the cap 120 and the shroud 110.

Figure 16:
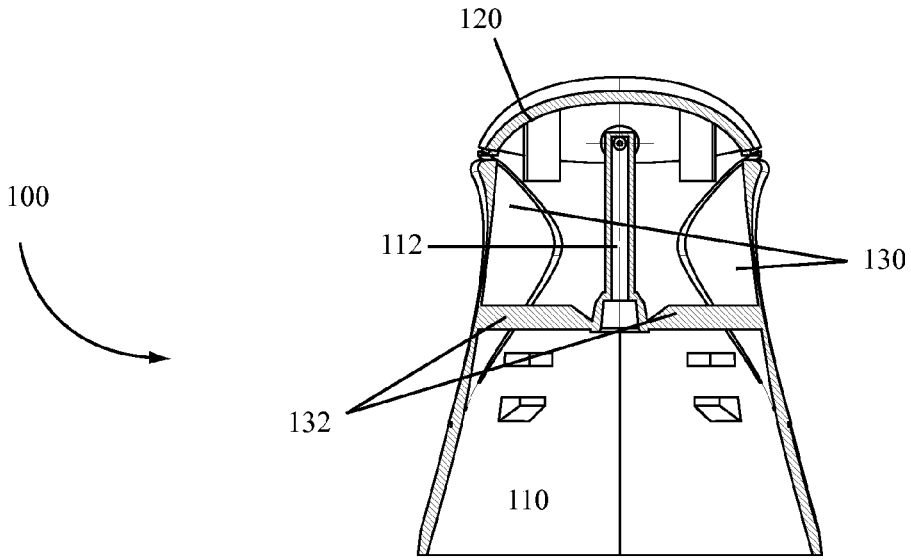
FIG. 16 illustrates a cross-sectional rear view of a spray device according to embodiments of the invention.
Figure 17:
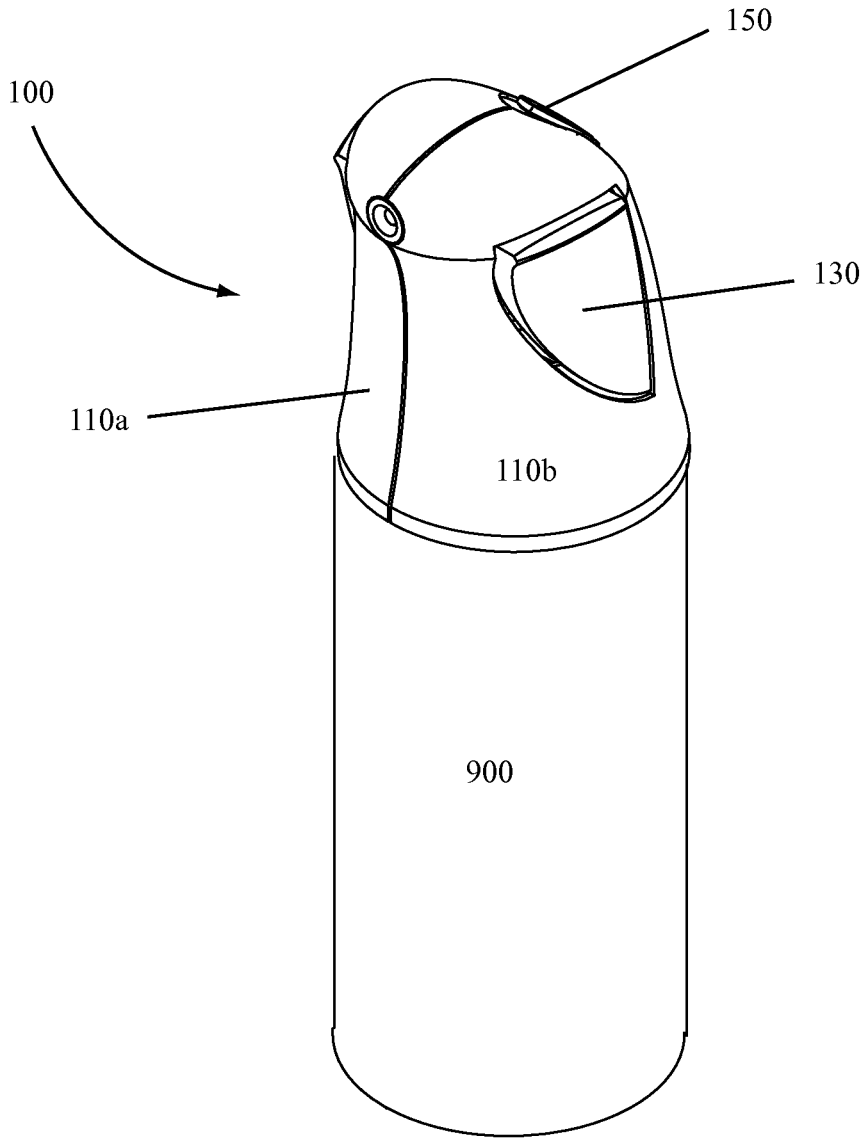
FIG. 17 illustrates a spray device and container according to various embodiments of the invention.

FIG. 16 illustrates a cross-sectional rear view of the spray device 100 illustrated in FIGS. 9 through 14. The spray device 100 may include a shroud 110, manifold 112, one or more actuators 130 and one or more actuator connectors 132 connected to, or in communication with, the manifold 112 and the one or more actuators 130. Upon actuation of at least one of the one or more actuators 130, the one or more actuator connectors 132 may translate force to the manifold 112, moving the manifold 112 and actuating the spray device 100.

According to embodiments of the invention, a user may utilize a spray device 100 with a one-handed operation. For example, the spray device 100 illustrated in FIGS. 9 through 16 may be grasped in one hand by a user. The user may move or position the selector mechanism 150 using one or more fingers of the hand grasping the spray device 100. In addition, the user may actuate the one or more actuators 130 by applying pressure to the one or more actuators 130. When the selector mechanism 150 is in an "on" position, actuation of the one or more actuators 130 may disperse product from the container 900 through the spray device 100. When the selector mechanism 150 is in an "off" position, the one or more actuators 130 may not be actuated, preventing the release of a product from the spray device 100.

According to other embodiments of the invention, a spray device 100 may include a rear actuator. A rear actuator may act in the same manner as a side actuator such as the one or more actuators 130 illustrated in FIGS. 1 and 9. As a force is applied to a rear actuator, the rear actuator may actuate the spray device 100, allowing a product to flow from a container through the spray device 100 for dispersion. A selector mechanism 150 for turning a rear actuator "on" or "off" may also be included in a rear actuated spray device according to embodiments of the invention.

A spray device 100 according to other embodiments of the invention is illustrated in FIGS. 17 through 26. A spray device 100 may include a two-part shroud 110 having a first shroud half 110*a* and a second shroud half 110*b*. The first shroud half 110*a* and the second shroud half 110*b* may snap together, or otherwise be assembled, to form a complete shroud 110. Each shroud half may include an actuator 130 assembled to the shroud 110, molded as an integral part of the shroud 110, or accessible through a portion of the shroud 110. A selector mechanism 150 may be included as a part of the spray device 100 if desired and may be used to lock the spray device in an "off" position, or prevent actuation of the one or more actuators, or to configure the spray device 100 in an "on" position where the one or more actuators 130 may be actuated.

Figure 18:
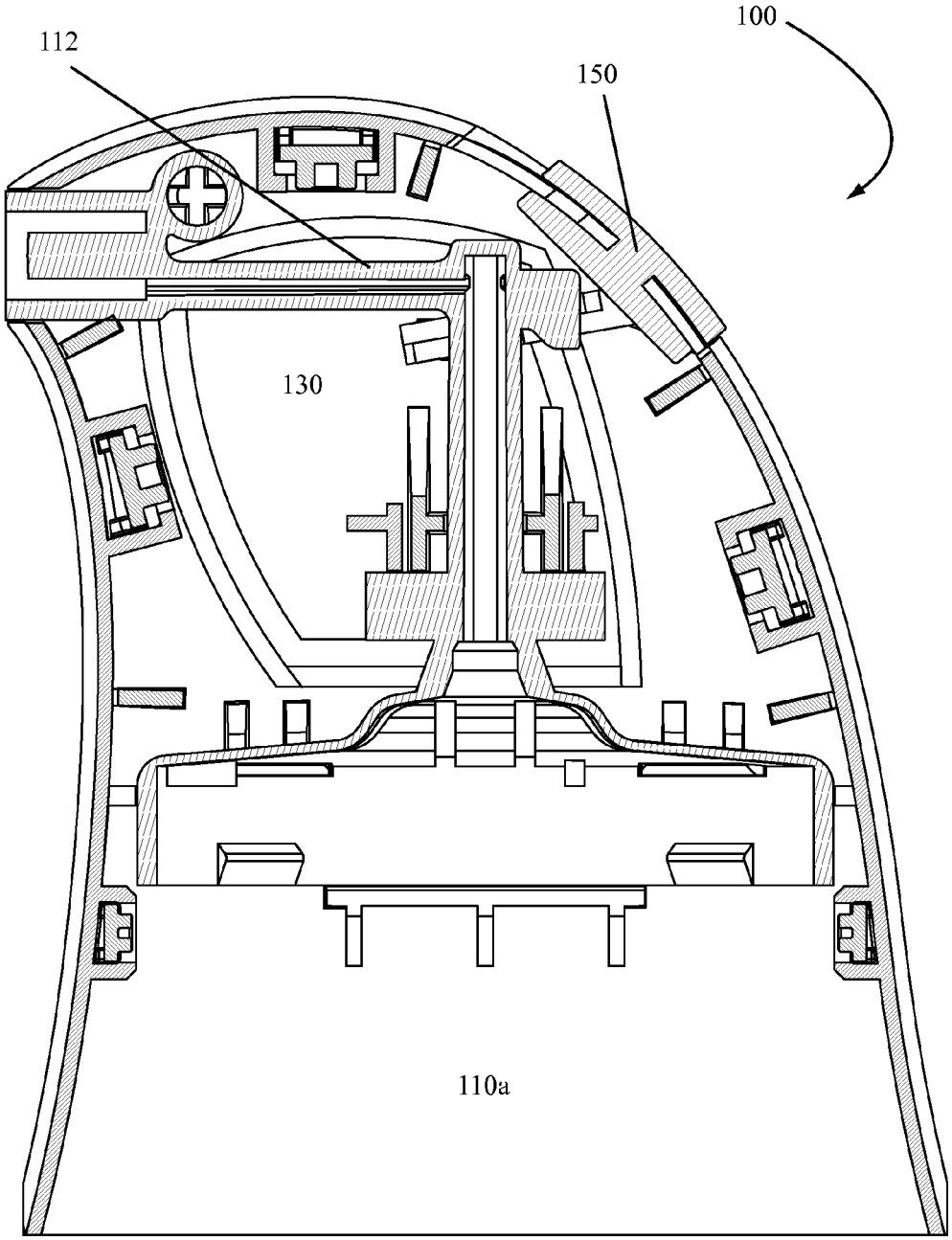
FIG. 18 illustrates a cross-sectional view of a spray device according to embodiments of the invention.

A cross-sectional view of a spray device 100 according to various embodiments of the invention is illustrated in FIG. 18, which is not necessarily drawn to scale. The spray device 100 may include a first shroud half 110*a*, an actuator 130, a manifold 112, and a selector mechanism 150 assembled as illustrated.

Figure 19:
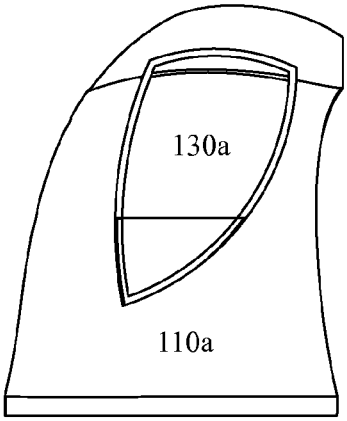
FIG. 19 illustrates a side-view of a spray device according to embodiments of the invention.
Figure 20:
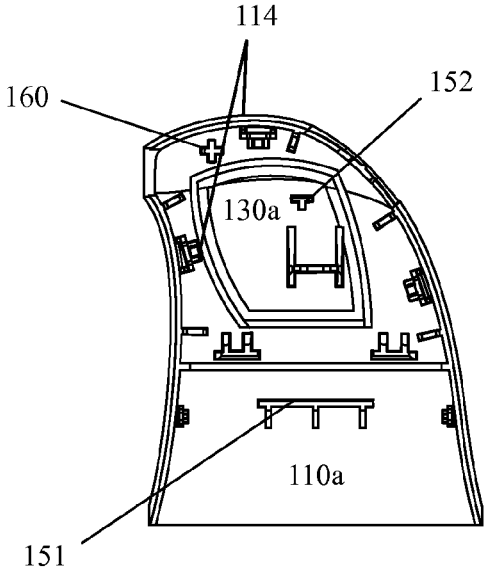
FIG. 20 illustrates an interior side-view of a spray device according to embodiments of the invention.

According to embodiments of the invention, an actuator 130 may be molded as an integral part of a shroud 110. As illustrated in FIGS. 19 and 20, a first actuator 130*a* may be an integral part of a first shroud half 110*a*. FIG. 19 illustrates an exterior view of a first shroud half 110*a* and FIG. 20 illustrates an interior view of a first shroud half 110*a*. The first actuator 130*a* may be molded as a part of the first shroud half 110*a* or may be connected to the first shroud half 110*a* by snap fit, welding, or other connection method as desired. Similarly, a second actuator 130*b* may be an integral part of a second shroud half 110*b* as illustrated in the exterior and interior views of a second shroud half 110*b* of FIGS. 21 and 22, respectively. The second actuator 130*b* may be molded as a part of the second shroud half 110*b* or may be connected to the second shroud half 110*b* by snap fit, welding, or other connection method as desired.

Figure 21:
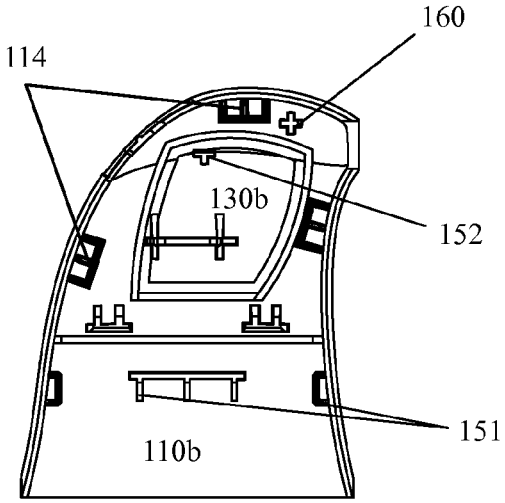
FIG. 21 illustrates an interior side-view of a spray device according to embodiments of the invention.
Figure 22:
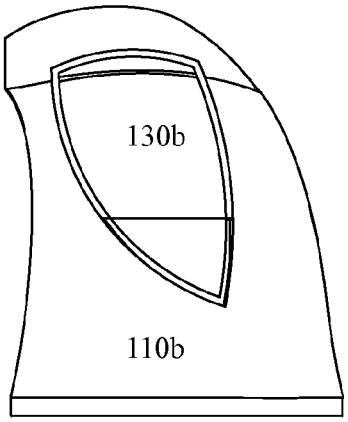
FIG. 22 illustrates a side-view of a spray device according to embodiments of the invention.

Each half of a shroud 110 may include one or more connection mechanisms, snaps, male and female joints, or other connectors which allow the shroud halves to be snapped or otherwise connected to form a shroud 110. For example, shroud connectors 114 may be molded with each shroud half as illustrated in FIGS. 20 and 21. The shroud connectors 114 may fit together and hold the two halves of a shroud 110 together as desired.

In some embodiments of the invention, a selector mechanism 150 may be used to select an "on" or an "off" position for the spray device 100. A selector mechanism 150 may have two positions, one corresponding to the "on" position and one corresponding to an "off" position. One or more selector mechanism contacts 152 may be included on one or both of the actuators 130. When a selector mechanism 150 is positioned in an "off" position, a selector mechanism contact 152 may be in contact with the selector mechanism 150 such that the contact between the selector mechanism contact 152 and the selector mechanism 150 prevents actuation of the manifold 112, actuation of the actuator 130, or both. Moving the selector mechanism 150 into an "on" position may alter the positioning of the selector mechanism 150 such that contact with a selector mechanism contact 152 does not inhibit the actuation of the manifold 112, actuation of the actuator 130, or both.

A shroud 110 may also include one or more container connectors 151. A container connector 151 may be configured to connect the shroud 110 to a container 900 or a portion of a container 900 such as a valve cup. A container connector 151 may also be configured to support the spray device 100 on a container 900. According to various embodiments of the invention, any number of container connectors 151 or container connection features may be used or molded with shroud 110 to facilitate connection or positioning of the shroud 110 onto a container 900.

According to embodiments of the invention, any manifold suited for the function of the spray device 100 may be used. In some embodiments, however, a manifold 112 such as that illustrated in FIGS. 23 through 27 may be used. A manifold according to various embodiments of the invention may include a valve adapter 201, a fluid flow path 211, and a discharge orifice 221. The fluid flow path 211 may provide a path for a fluid or other product to flow through from the valve adapter 201 to the discharge orifice 221. When attached to a container 900, the valve adapter 201 may fit against or mate with a valve element 910.

Figure 24:
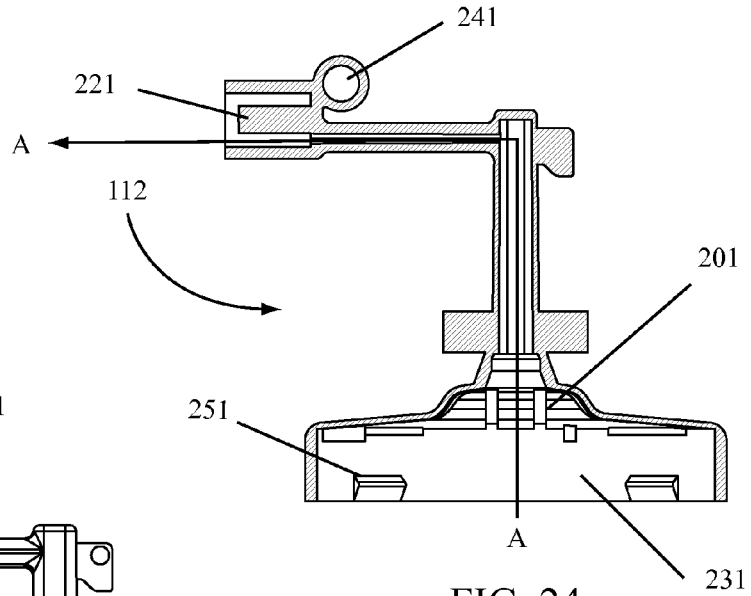
FIG. 24 illustrates a cross-sectional view of a manifold according to embodiments of the invention.

As illustrated in the cross-sectional view of a manifold 112 of FIG. 24, the flow path A of fluid or a product through the manifold 112 includes passage through the valve adapter 201, the fluid flow path 211 and exiting the discharge orifice 221. In some embodiments of the invention, an orifice cup 140 may be positioned in the discharge orifice 221 and the fluid or product may pass through the orifice cup 140 before exiting the spray device 100.

A manifold 112 may also include a manifold base 231. The manifold base 231 may support the fluid flow path 211 and may be configured to aid assembly of the manifold 112 with the spray device 100. For example, the inclusion of a manifold base 231 may assist in the automatic separation of manifolds 112 during an assembly process where large numbers of manifolds 112 are deposited into feeder boxes. The size and shape of the manifold base 231 may prevent the manifolds 112 from becoming entangled or otherwise connected, thereby reducing errors or stoppage during assembly of a spray device 100.

A manifold base 231 may also include one or more container connection features 251. A container connection feature 251 may be configured to help support a manifold 112 on a container 900 or on a portion of a container 900 such as a valve cup. The container connection features 251 may be configured to snap or otherwise connect to or support a spray device 100 on a container 900.

A manifold 112 according to embodiments of the invention may also include one or more flexible members 271 supporting the valve adapter 201, fluid flow path 211, and discharge orifice 221 on the manifold base 231. The flexible members 271 may flex as the manifold 112 is actuated in a spray device 100.

Figure 23:
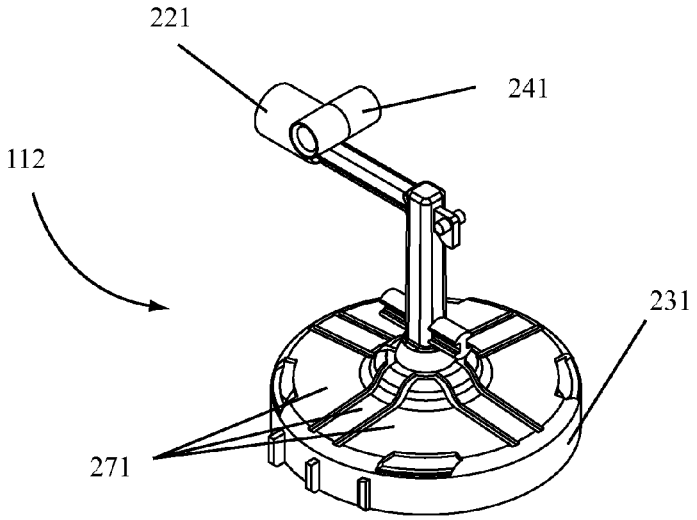
FIG. 23 illustrates a view of a manifold according to embodiments of the invention.
Figure 25:
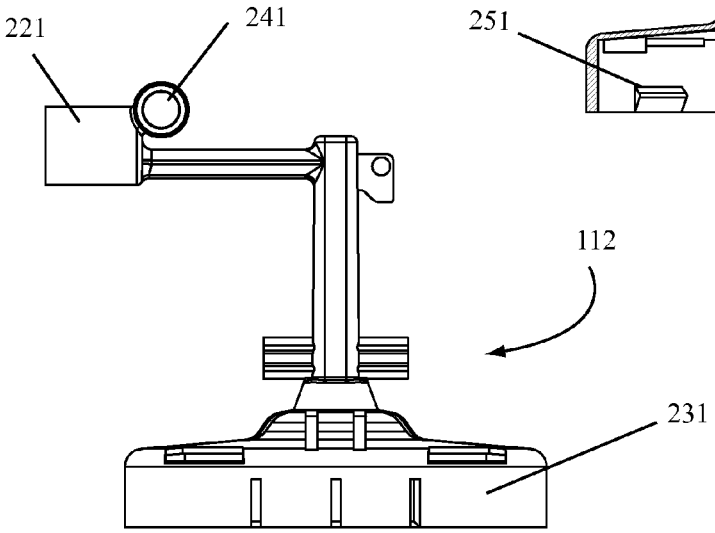
FIG. 25 illustrates a side-view of a manifold according to embodiments of the invention.

A manifold 112 according to embodiments of the invention may also include one or more pivot guides 241 as illustrated in FIGS. 23 through 25. A pivot guide 241 may mate with one or more guides 160 on a shroud 110. The pivot guide 241 may help fix the manifold 112 in a proper position within the spray device 100 for assembly to a can or may be used for alignment purposes during assembly.

Other features may also be added to or include as a part of a manifold 112 to assist with the pre-assembly of a manifold 112 with a spray device 100 or to assist with the assembly or positioning of a manifold 112 in a spray device 100.

Figure 28:
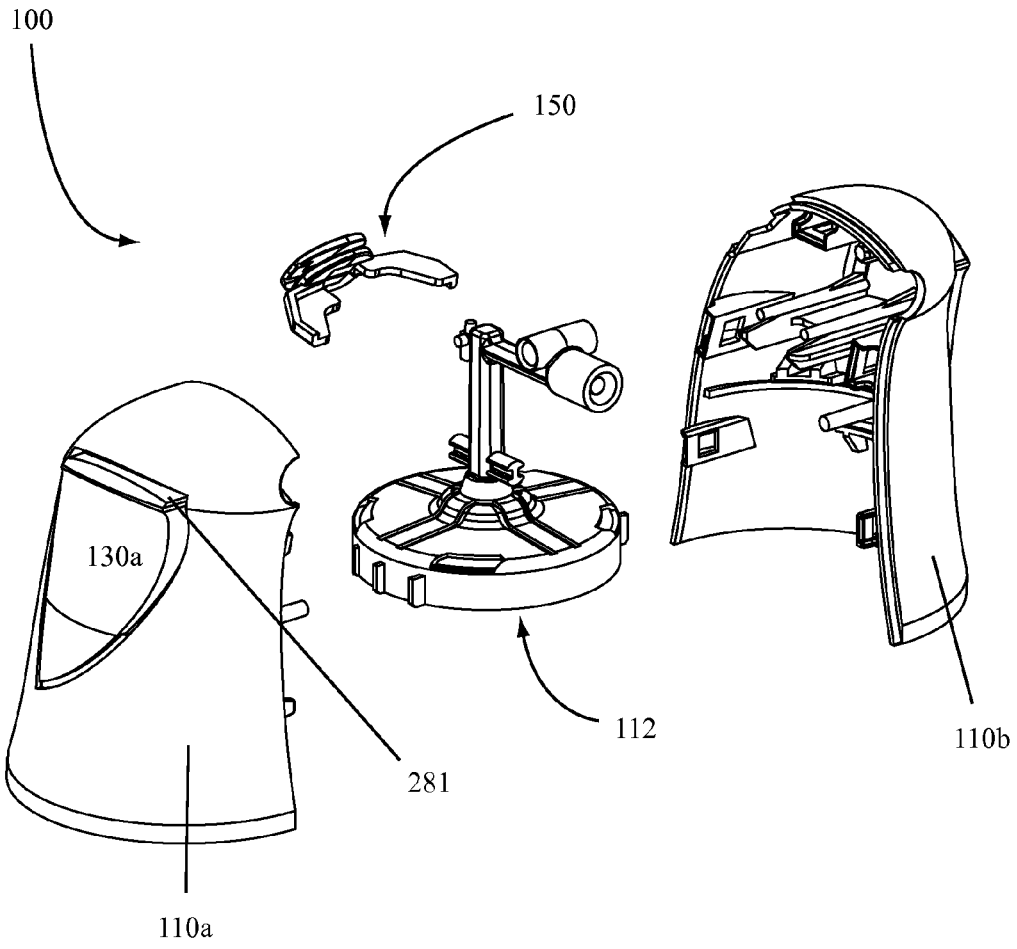
FIG. 28 illustrates a view of a disassembled spray device according to various embodiments of the invention.

An exploded view of a spray device 100 according to embodiments of the invention is illustrated in FIG. 28. As the spray device 100 is assembled, the shroud 110 is formed from a first shroud half 110a and a second shroud half 110*b*. A manifold 112 is positioned between the shroud halves along with a selector mechanism 150. In some embodiments, an orifice cup 140 may be inserted into the discharge orifice 221 of the manifold 112 or positioned in the shroud 110 as desired to alter the flow of product from the spray device 100.

According to some embodiments of the invention, a lip 281 on shroud 110 may prevent actuation of an actuator 130 if the spray device 100 is tipped on its side. For example, a lip 181 portion of the shroud 110 may extend over an actuator 130 or further away from the manifold than the actuator 130 such that if the spray device 100 rests on its side on a surface, the actuator 130 will not be depressed or actuated; rather the shroud 110 will rest on the surface.

According to various embodiments of the invention, a spray device 100 may be actuated using one or more actuators 130 located on the sides of the spray device 100 or by using one or more rear actuators located on the rear side of a spray device 100 or on the side opposite an exit or orifice cup through which product is released from the spray device 100. Further, a spray device 100 may include one or more selector mechanisms 150 which may inhibit or limit the actuation of the one or more actuators 130 of the spray device. In other embodiments of the invention, a selector mechanism 150 may be adapted to select a spray pattern or orifice cup through which a product will be dispersed.

According to embodiments of the invention, a spray device 100 may be used to disperse any aerosol product or pressurized gas propelled product. For example, a spray device 100 according to embodiments of the invention may be used to disperse hair care products, lotion products, sunscreen products, make-up products, air care products, hard surface cleaners, paints, fabric products, deodorants, gels, foams, cleaning agents, and other products as desired. When a selector mechanism is in an "on" position, actuation of one or more of the actuators 130 translates forces to a manifold 112 causing the manifold to actuate a valve element 910 on a container 900 which releases a product through the manifold 112 and out disperses it from the spray device 100.

Figure 26:
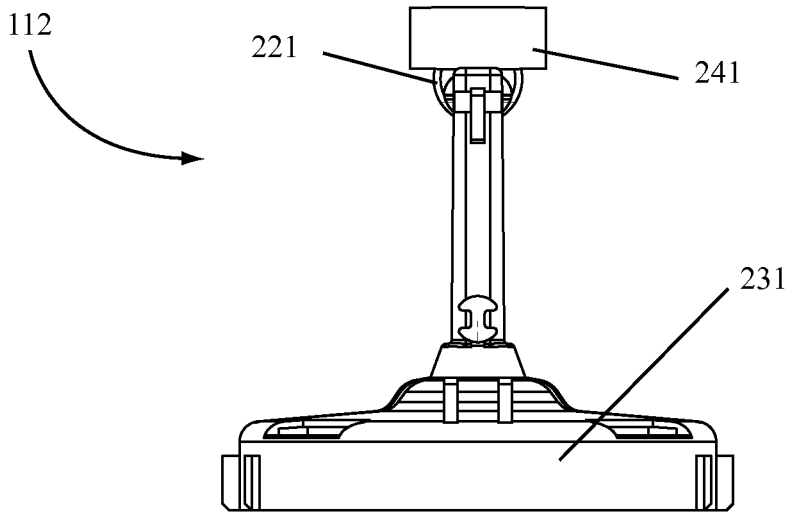
FIG. 26 illustrates a rear-view of a manifold according to embodiments of the invention.
Figure 27:
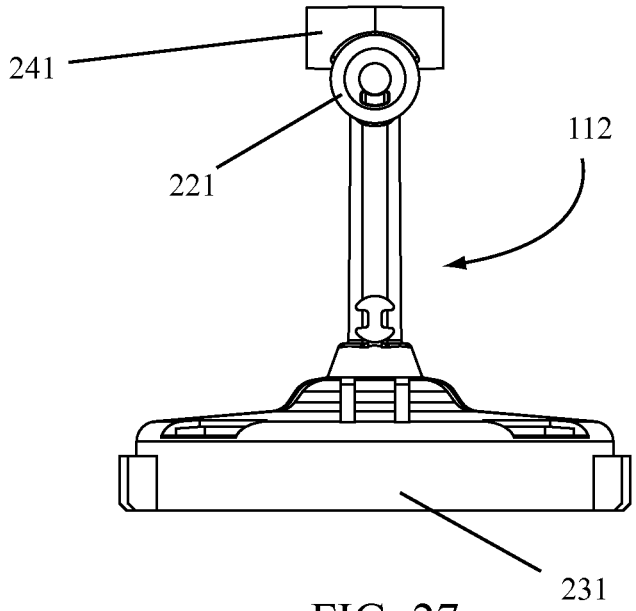
FIG. 27 illustrates a front-view of a manifold according to embodiments of the invention.

According to various embodiments of the invention, a spray device 100 may include three parts: a first shroud half 110*a*, a second shroud half 110*b* and a manifold 112. The first shroud half 110*a* and second shroud half 110*b* may be assembled around the manifold 112 and connected or snapped together to form a spray device 100 which may be snapped to or otherwise connected to a container 900. In other embodiments of the invention, a fourth part—a selector mechanism 150—may be included in the assembly as illustrated in FIG. 26. In still other embodiments, an additional part—an orifice cup 140—may be assembled with the three-part spray device 100 or four-part spray device 100.

The various parts or components of a spray device 100 may be molded from a plastic or resin material or made from any desired material.

It is understood that the various components of the spray devices 100 of the present invention may be scaled up or down as desired to fit different container sizes, hand sizes, or desired applications.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. A spray device, comprising:

a shroud, comprising:

a first shroud half;

at least one first shroud half shroud connector integrally molded with the first shroud half;

a second shroud half;

at least one second half shroud connector integrally molded with the second shroud half; and wherein the at least one first shroud half shroud connector is snapped to the at least one second half shroud connector;

a first actuator integrally molded with the first shroud half and moveable relative to the first shroud half;

a second actuator integrally molded with the second shroud half and moveable relative to the second shroud half;

a manifold positioned between the first shroud half and the second shroud half, wherein the manifold is in contact with the first actuator and the second actuator; and a selector mechanism moveably retained between the first shroud half and the second shroud half between an "on" position allowing actuation of the spray device and an "off" position wherein the selector mechanism interacts with the first actuator and the second actuator to prevent actuation of the first actuator and the second actuator.

2. A spray device, comprising:

a two-part shroud comprising a first shroud half and a second shroud half snapped together, wherein the first shroud half and the second shroud half further comprise at least one container connector for attaching the spray device to a container;

a manifold positioned between the first shroud half and the second shroud half;

a selector mechanism moveably positioned between the first shroud half and the second shroud half;

a first actuator assembled to the first shroud half;

a second actuator assembled to the second shroud half;

at least one selector mechanism contact on each of the first actuator and second actuator; and wherein the selector mechanism includes an "off" position in which the selector mechanism engages the at least one selector mechanism contact on each of the first actuator and second actuator to prevent actuation of the manifold and an "on" position in which the selector mechanism does not engage the at least one selector mechanism contact on each of the first actuator and second actuator to allow actuation of the manifold.

3. The spray device of claim 2, wherein the first shroud half further comprises at least one first shroud connection, the second shroud half further comprises at least one second shroud connection, and wherein the at least one first shroud connection snap-fits with the at least one second shroud connection.

4. The spray device of claim 2, wherein the first actuator is actuated independently of the second actuator and the second actuator is actuated independently of the first actuator.

5. A spray device, comprising:

a two-part shroud comprising a first shroud half and a second shroud half snapped together and at least one container connector for attaching the spray device to a container;

a manifold positioned between the first shroud half and the second shroud half;

a selector mechanism moveably positioned between the first shroud half and the second shroud half;

a first actuator molded to the first shroud half;

a second actuator molded to the second shroud half;

at least one selector mechanism contact on each of the first actuator and second actuator; and wherein the selector mechanism includes an "off" position in which the selector mechanism engages the at least one selector mechanism contact on each of the first actuator and second actuator to prevent actuation of the manifold and an "on" position in which the selector mechanism does not engage the at least one selector mechanism contact on each of the first actuator and second actuator to allow actuation of the manifold.

6. The spray device of claim 5, wherein the first shroud half further comprises at least one first shroud connection, the second shroud half further comprises at least one second shroud connection, and wherein the at least one first shroud connection snap-fits with the at least one second shroud connection.

7. The spray device of claim 5, wherein the first actuator is actuated independently of the second actuator and the second actuator is actuated independently of the first actuator.

8. The spray device of claim 5, wherein the first actuator is moveable relative to the first shroud half.

9. The spray device of claim 8, wherein the selector mechanism prevents movement of the first actuator when in the "off" position.

10. The spray device of claim 5, wherein the second actuator is moveable relative to the second shroud half.

11. The spray device of claim 10, wherein the selector mechanism prevents movement of the second actuator when in the "off" position.

* * * * *